US011394164B2

(12) United States Patent
Hung

(10) Patent No.: US 11,394,164 B2
(45) **Date of Patent: *Jul. 19, 2022**

(54) DETACHABLE CASSETTE FOR MACHINING CONNECTOR AND CRIMP TOOL

(71) Applicant: Sullstar Technologies, Inc., Simi Valley, CA (US)

(72) Inventor: Wen-Lung Hung, New Taipai (TW)

( * ) Notice: Subject to any disclaimer, the term of this patent is extended or adjusted under 35 U.S.C. 154(b) by 239 days.

This patent is subject to a terminal disclaimer.

(21) Appl. No.: 16/532,461

(22) Filed: Aug. 5, 2019

(65) Prior Publication Data

US 2019/0363501 A1 Nov. 28, 2019

Related U.S. Application Data

(63) Continuation of application No. 14/998,646, filed on Jan. 29, 2016, now Pat. No. 10,490,963.

(30) Foreign Application Priority Data

Oct. 13, 2015 (TW) ..... 104133572

(51) Int. Cl.
*H01R 43/04* (2006.01)
*H01R 43/042* (2006.01)
*B25B 27/14* (2006.01)

(52) U.S. Cl.
CPC ..... *H01R 43/0421* (2013.01); *B25B 27/14* (2013.01); *H01R 43/0425* (2013.01)

(58) Field of Classification Search
CPC ..... H01R 43/015; H01R 43/042; H01R 43/0421; H01R 43/0425; H01R 43/0428;
(Continued)

(56) References Cited

U.S. PATENT DOCUMENTS 5,913,933 A 6/1999 Beetz et al.
5,941,120 A 8/1999 Jee
(Continued)

FOREIGN PATENT DOCUMENTS

CN 1599153 A 3/2005
CN 102231467 A 11/2011
(Continued)

OTHER PUBLICATIONS

China National Intellectual Property Adminstration (CNIPA); First Office Action (1OA) English translation for corresponding Chinese patent application No. 201811381502.8, entitled Detachable Cassette for Machining Connector and Crimp Tool Having the Same by Wen-Lung Hung, dated Nov. 13, 2019 from China National Intellectual Property Administration, 9 pgs.
(Continued)

*Primary Examiner* — Debra M Sullivan
(74) *Attorney, Agent, or Firm* — Charles C. H. Wu; Wu & Reddy, A Prof. Corp.

(57) ABSTRACT

The invention is related to a cassette for machining a connector. The cassette is detachably disposed in a tool body having a head and a driving element. The direction of motion of the driving element defines a first axis. The cassette comprises: a cassette body and a machining block. The cassette body is detachably disposed in an opening of the head of the tool body and has a machining opening therein. The machining block is slidably disposed in the cassette body along the first axis and has an engagement element detachably engaged with the driving element of the tool body. Through the engagement element, the driving element drives the machining block to slide along the first axis to move toward or away from the machining opening.

17 Claims, 9 Drawing Sheets

(58) Field of Classification Search
CPC ..... B25B 27/146; Y10T 29/53209; Y10T 29/53222; Y10T 29/53226; Y10T 29/5313
See application file for complete search history.

(56) References Cited

U.S. PATENT DOCUMENTS

| | | | | |
|---|---|---|---|---|
| 7,103,968 | B2 | 9/2006 | Karrasch | |
| 8,296,956 | B2 | 10/2012 | Battenfield | |
| 8,839,506 | B2 | 9/2014 | Slater et al. | |
| 10,490,963 | B2 * | 11/2019 | Hung | H01R 43/0425 |
| 2002/0056309 | A1 | 5/2002 | Beetz et al. | |
| 2009/0044410 | A1 | 2/2009 | Battenfield | |
| 2009/0217791 | A1 | 9/2009 | Battenfield | |
| 2010/0071202 | A1 | 3/2010 | Peng et al. | |
| 2011/0047790 | A1 | 3/2011 | Peng et al. | |
| 2011/0197648 | A1 | 8/2011 | Houser et al. | |
| 2012/0110837 | A1 | 5/2012 | Slater et al. | |
| 2012/0144893 | A1 | 6/2012 | Battenfield | |
| 2013/0125381 | A1 | 5/2013 | Lin | |
| 2013/0232786 | A1 | 9/2013 | Chawgo | |

FOREIGN PATENT DOCUMENTS

| | | | |
|---|---|---|---|
| EP | 2026433 | A2 | 2/2009 |
| EP | 2166625 | A2 | 3/2010 |
| JP | 2003-123934 | A | 4/2003 |
| JP | 2009-050152 | A | 3/2009 |
| TW | 201110484 | A | 3/2011 |

OTHER PUBLICATIONS

China National Intellectual Property Adminstration (CNIPA); Search Report (Search_Rpt-DV1) English translation for corresponding Chinese patent application No. 201811381502.8, entitled Detachable Cassette for Machining Connector and Crimp Tool Having the Same by Wen-Lung Hung, dated Nov. 13, 2019 from China National Intellectual Property Administration, 3 pgs.

European Patent Office (EPO); extended European Search Report (eESR) for corresponding patent application No. 19 15 4961.7 entitled Detachable Cassette for Machining Connector and Crimp Tool Having the Same by Wen-Lung Hung, dated May 16, 2019 from European Patent Office, 9 pgs.

European Patent Office (EPO); Office Action (OA) for corresponding patent application No. 16 154 476.2 entitled Detachable Cassette for Machining Connector and Crimp Tool Having the Same by Wen-Lung Hung, dated Feb. 16, 2018 from European Patent Office, 6 pgs.

Japan Patent Office (JPO); Office Action (OA) English translation for corresponding patent application No. 2016-201640 entitled Detachable Cassette for Machining Connector and Crimp Tool Having the Same by Wen-Lung Hung, dated Feb. 13, 2018 from Japan Patent Office, 4 pgs.

Platinum Tools; EZ-Viking Crimp Tool Catalog published in Jan. 2013 from Platinum Tools in Camarillo, California, United States of America, 2 pgs.

Korean Intellectual Property Office (KIPO); First Office Action (1OA) English translation for corresponding Korean patent application No. 10-2016-0132743, entitled Detachable Cassette for Machining Connector and Crimp Tool Having the Same by Wen-Lung Hung, dated Aug. 17, 2017 from Korean Intellectual Property Office, 5 pgs.

Korean Intellectual Property Office (KIPO); Second (2OA) English translation Office Action for corresponding Korean patent application No. 10-2016-0132743, entitled Detachable Cassette for Machining Connector and Crimp Tool Having the Same by Wen-Lung Hung, dated Mar. 29, 2018 from Korean Intellectual Property Office, 4 pgs.

Korean Intellectual Property Office (KIPO); Final Rejection (Final_Rej) English translation Office Action for corresponding Korean patent application No. 10-2016-0132743, entitled Detachable Cassette for Machining Connector and Crimp Tool Having the Same by Wen-Lung Hung, dated Sep. 17, 2018 from Korean Intellectual Property Office, 6 pgs.

Taiwan Intellectual Property Office (IPO); First Office Action (1OA) English translation for corresponding Taiwan patent application No. 106107281 entitled Detachable Cassette for Machining Connector and Crimp Tool Having the Same by Wen-Lung Hung, dated Nov. 30, 2017 from Intellectual Property Office, 7 pgs.

Intellectual Property Office (IPO); Search Report (Search_Rpt-DV1) English translation for corresponding Taiwan patent application No. 106107281 entitled Detachable Cassette for Machining Connector and Crimp Tool Having the Same by Wen-Lung Hung, dated Nov. 30, 2017 from Intellectual Property Office, 2 pgs.

Intellectual Property Office (IPO); First Office Action (1OA) English translation for corresponding Taiwan patent application No. 107114756 entitled Detachable Cassette for Machining Connector and Crimp Tool Having the Same by Wen-Lung Hung, dated Nov. 29, 2018 from Intellectual Property Office, 4 pgs.

Intellectual Property Office (IPO); Search Report (Search_Rpt-DV2) English translation for corresponding Taiwan patent application No. 107114756 entitled Detachable Cassette for Machining Connector and Crimp Tool Having the Same by Wen-Lung Hung, dated Nov. 28, 2018 from Intellectual Property Office, 2 pgs.

Korean Intellectual Property Office (KIPO); First Office Action (1OA) English translation for corresponding Korean patent application No. 10-2019-0008929, entitled Detachable Cassette for Machining Connector and Crimp Tool Having the Same by Wen-Lung Hung, dated Apr. 29, 2019 from Korean Intellectual Property Office, 3 pgs.

Japan Patent Office (JPO); First Office Action (1OA) English translation for corresponding patent application No. 2019-002992 entitled Detachable Cassette for Machining Connector and Crimp Tool Having the Same by Wen-Lung Hung, dated Feb. 26, 2020 from Japan Patent Office, 3 pgs.

Platinum Tools; EZ-Viking Crimp Tool Catalog published in Jan. 2013 from Platinum Tools in Camarillo, CA, United States of America, 2 pgs.

Korean Intellectual Property Office (KIPO); First Office Action (1OA) English translation for corresponding patent application No. 10-2020-0008929, entitled Detachable Cassette for Machining Connector and Crimp Tool Having the Same by Wen-Lung Hung, dated Sep. 25, 2020, 4 pgs.

European Patent Office (EPO); Office Action (OA) for corresponding patent application No. 19154961.7, entitled A Crimp Tool Receiving a Detachable Cassette for Machining Connector by Wen-Lung Hung, dated Mar. 23, 2021, 8 pgs.

* cited by examiner

DETACHABLE CASSETTE FOR MACHINING CONNECTOR AND CRIMP TOOL

CROSS-REFERENCE TO RELATED APPLICATIONS

The present application is a continuation of U.S. patent application Ser. No. 14/998,646, by Wen-Lung Hung, entitled DETACHABLE CASSETTE FOR MACHINING CONNECTOR AND CRIMP TOOL, filed Jan. 29, 2016, which claims the benefit of Taiwan application No. 104133572, by Wen-Lung Hung, entitled DETACHABLE CASSETTE FOR MACHINING CONNECTOR AND CRIMP TOOL HAVING THE SAME, issued as Taiwan Patent 1581920, both herein incorporated by reference in their entireties.

BACKGROUND

Field of the Invention

The present invention relates to a device for machining an article, in particular, a detachable cassette for machining a connector and a crimp tool having the same.

Description of Related Art

Cables or wires are commonly used for transmitting signals between electronic devices. For example, cables are used for transmitting signals from and to televisions, telephones, computers etc. These signals include: video signals, audio signals and packed data. Connectors are used for connecting cables with electronic devices and are usually disposed at the ends of the cables. These connectors include an RJ-45 connector, a connector standardized as the 8P8C modular connector, and an RJ-11 connector, a connector for telephone connections etc. When the connector housing is crimped to secure the internal position of the wires, its internally contained electrical contact blades also assume the positions in which they will matingly engage the blades of corresponding contacts in the receptacle of an associated female connector. Conventional crimp tools, such as the pliers described in U.S. Pat. No. 5,941,120, are used for crimping insulated cables and connectors so that they are electrically and physically connected. Furthermore, Taiwan Pat. Pub. No. 534510 discloses a tool for crimping a cable connector, which can shear, strip and crimp insulated cables respectively with different portions thereof.

However, each of these conventional tools can only crimp connectors and cables of particular specifications. Thus, to crimp connectors and cables with different specifications, a user needs to carry several different crimp tools, which is inconvenient and cumbersome for the user.

Given the above, there is need for a single crimp tool that can crimp connectors and cables with different specifications.

BRIEF SUMMARY OF THE INVENTION

In one embodiment of the invention, a cassette for machining a connector is provided. The cassette is detachably disposed in a tool body having a head and a driving element. The direction of motion of the driving element defines a first axis. The cassette comprises: a cassette body and a machining block. The cassette body is detachably disposed in an opening of the head of the tool body and has a machining opening therein. The machining block is slidably disposed in the cassette body along the first axis and has an engagement element detachably engaged with the driving element of the tool body. Through the engagement element, the driving element drives the machining block to slide along the first axis to move toward or away from the machining opening.

In another embodiment of the invention, a crimp tool is provided, which comprises: a tool body and a cassette. The tool body comprises: a first handle, a second handle, a head and a driving element. The second handle is pivotally connected with the first handle. The head is connected with the first handle. The driving element is connected with and actuated by the second handle. The direction of motion of the driving element defines a first axis. The cassette comprises: a cassette body and a machining block. The cassette body is detachably disposed in an opening of the head of the tool body and has a machining opening therein. The machining block is slidably disposed in the cassette body along the first axis and has an engagement element for being detachably engaged with the driving element of the tool body. Through the engagement element, the driving element drives the machining block to slide along the first axis to move toward or away from the machining opening.

DETAILED DESCRIPTION OF THE EXEMPLARY EMBODIMENTS

Figure 1A:
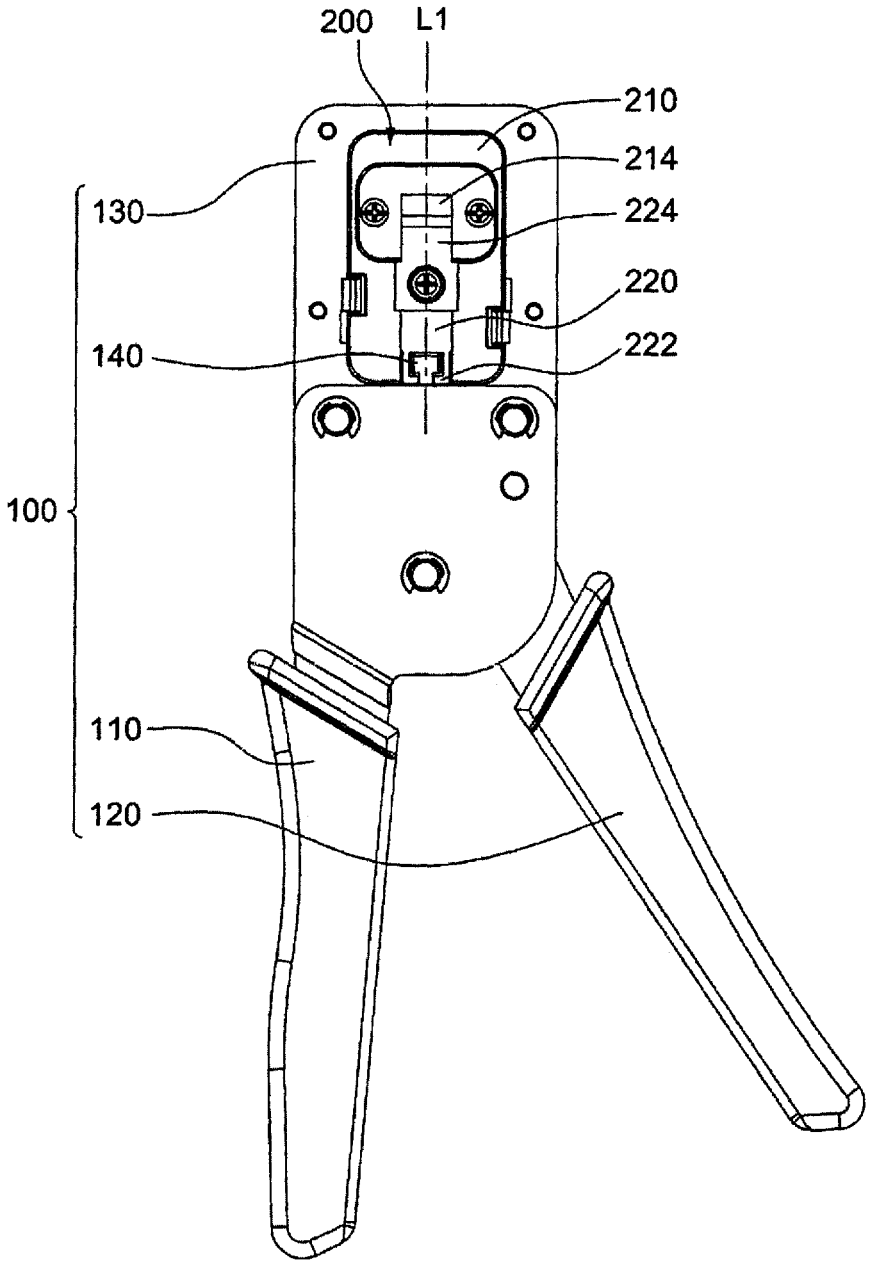
FIG. 1A is a schematic view showing the crimp tool of one embodiment of the present invention in a resting state.

The characteristics, subject matter, advantages, and effects of the present invention are detailed hereinafter by reference to embodiments of the present invention and the accompanying drawings. It is understood that the drawings referred to in the following description are intended only for purposes of illustration and do not necessarily show the actual proportion and precise arrangement of the embodiments. Therefore, the proportion and arrangement shown in the drawings should not be construed as limiting or restricting the scope of the present invention.

Figure 1B:
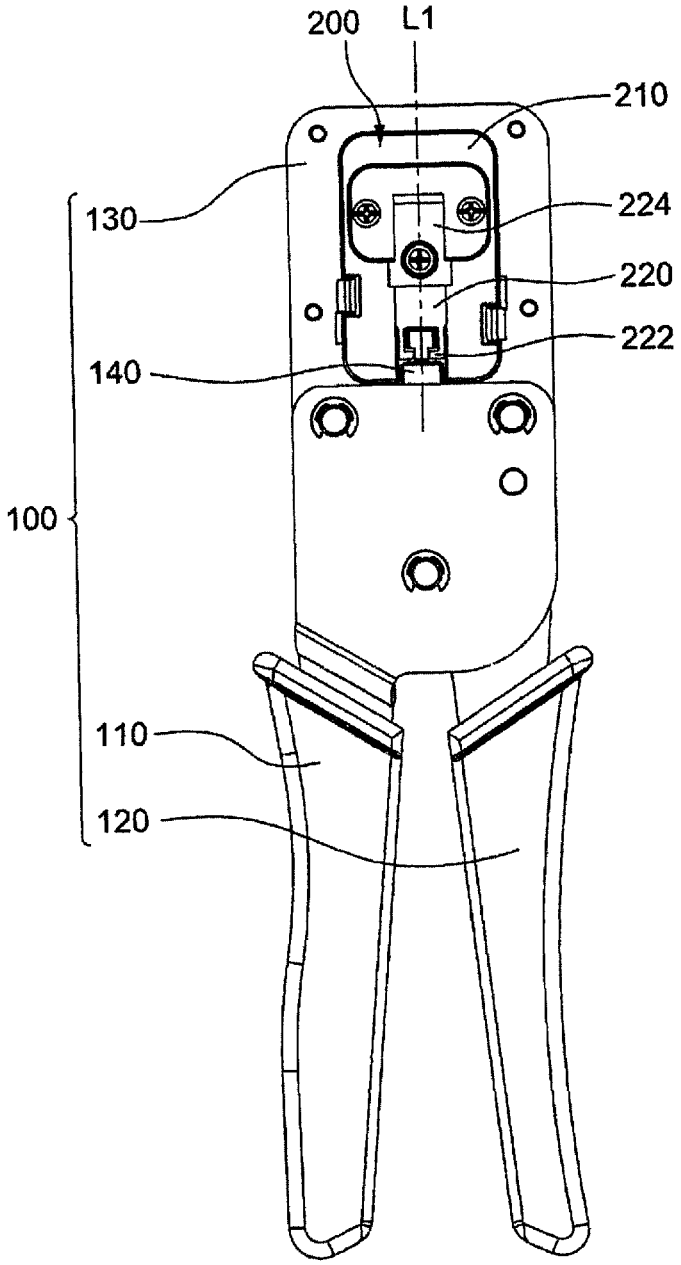
FIG. 1B is a schematic view showing the crimp tool of the embodiment in a working state.

Please refer to FIGS. 1A and 1B. FIG. 1A shows the crimp tool 10 of one embodiment of the present invention in a resting state wherein the handles 110, 120 thereof are in an expanded position and FIG. 1B shows the crimp tool 10 in a working state wherein the handles 110, 120 of the crimp tool 10 of the embodiment are in a contracted position. As shown in FIGS. 1A and 1B, the crimp tool 10 comprises: a tool body 100 and a cassette 200. The tool body 100 comprises: a first handle 110, a second handle 120, a head 130 and a driving element 140. The second handle 120 is pivotally connected with the first handle 110 wherein the second handle 120 pivots along a rotational path between a first position where the second handle 120 is away from the first handle 110 (as shown in FIG. 1A) and a second position where the second handle 120 is adjacent to the first handle 110 (as shown in FIG. 1B). The head 130 is connected with the first handle 110 and has an opening 131 for receiving the cassette 200. The driving element 140 is connected with and actuated by the second handle 120. When a user grasps the handles 110, 120, the second handle 120 urges the driving element 140 to move upward and the cassette 200 is actuated to machine the connector and the cable, such as shearing and/or crimping the connector and the cable. The crimp tool 10 is then switched from the resting state to the working state. When the user releases the handles 110, 120, a spring provided at the pivot of the two handles 110, 120 biases the second handle 120 so that the handles 110, 120 are urged into the expanded position, and the driving element 140 retreats to its original position. The crimp tool 10 is then switched from the working state to the resting state. During the above operation, the direction of motion (i.e., upward or downward direction) of the driving element 140 defines a first axis (L1).

As shown in FIGS. 2A, 2B, 3A, 3B, 7A and 7B, the cassette 200 comprises: a cassette body 210 and a machining block 220. The cassette body 210 is detachably disposed in an opening 131 of the head 130 of the tool body 100 and has a machining opening 214 therein. The cassette body 210 is provided with a slot 212 therein and the machining block 220 is slidably disposed in the slot 212 along the first axis (L1). With this detachable design, the crimp tool 10 of one embodiment of the present invention can crimp connectors and cables with different specifications by using corresponding cassettes 200. The machining opening 214 of the cassette 200 fits with a particular connector (e.g., RJ-45 connector, RJ-11 connector or the like) and cable. Different cassettes can be used with connectors and cables of different specifications. That is, one embodiment of the present invention provides a tool body 100 that can be used with cassettes of different machining openings. The cassette bodies of these cassettes are of the same or similar outer configurations such that all of them can fit with the opening 131 of the same tool body 100.

The machining block 220 slidably provided in the slot 212 of the cassette body 210 and the engagement element 222 of the tool body 100 are interconnected. The machining block 220 has an engagement element 222 for being detachably engaged with the driving element 140 of the tool body 100. Through the engagement element 222, the driving element 140 drives the machining block 220 to slide along the first axis (L1) to move toward or away from the machining opening 214. When the handles 110, 120 are pressed to move toward to each other, the second handle 120 urges the driving element 140 to move upward and the driving element 140 pushes the machining block 220 to slide upward along the first axis (L1) to machine the connector and the cable via the engagement between the driving element 140 and the engagement element 222. In one embodiment of the present invention, the driving element 140 is a male structure, such as a T-shaped protrusion, and the engagement element 222 is a female structure, such as a groove that matches with the T-shaped protrusion. The T-shaped structure prevents the driving element 140 from being easily disengaged from the engagement element 222. As such, the machining block 220 is actuated by the driving element 140 to slide upward or downward in a slot 212 along the first axis (L1).

Figure 2A:
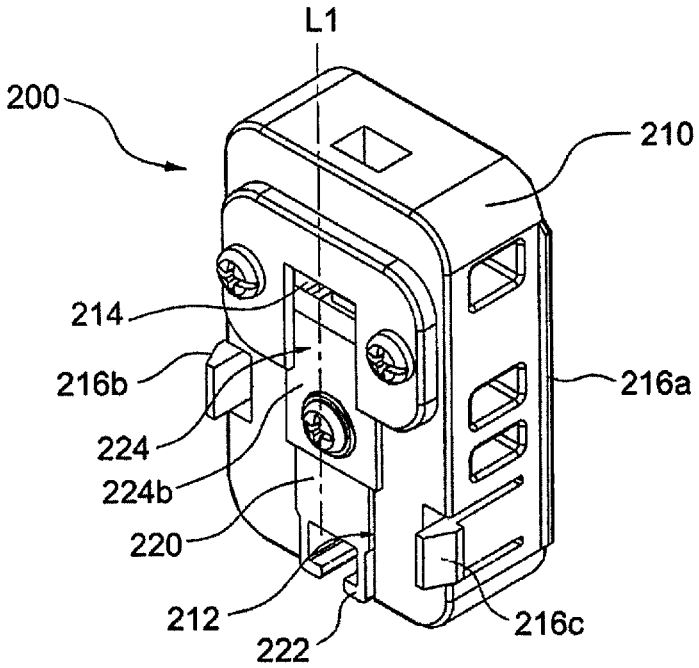
FIG. 2A is a schematic view showing the cassette of one embodiment of the present invention in a resting state wherein a shearing structure is shown.
Figure 2B:
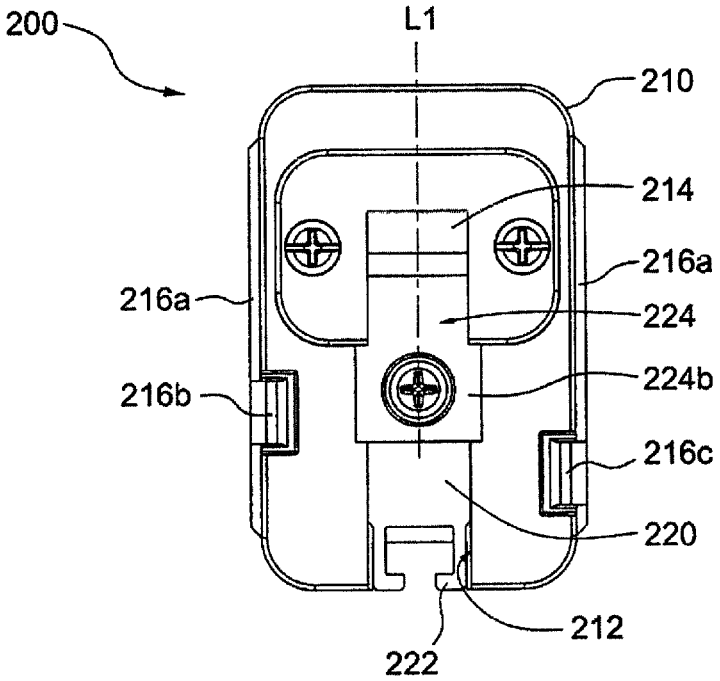
FIG. 2B is another schematic view showing the cassette of the embodiment in the resting state wherein the shearing structure is shown.

As illustrated in FIGS. 2A-58, the machining opening 214 is provided in the cassette body 210 for machining a connector. Corresponding to the machining opening 214, the machining block 220 comprises: at least one machining structure 224. In operation, the engagement element 222 is actuated by the driving element 140 so that the machining block 220 having the engagement element 222 slides along the first axis (L1) in the slot 212 in relation to the machining opening 214. When the machining block 220 is driven to a working position, the at least one machining structure 224 at least partially overlaps with the machining opening 214. As such, the at least one machining structure 224 machines the connector placed in the machining opening 214, such as crimping or shearing a connector having a cable for telephone connections or local area network (LAN).

Figure 3A:
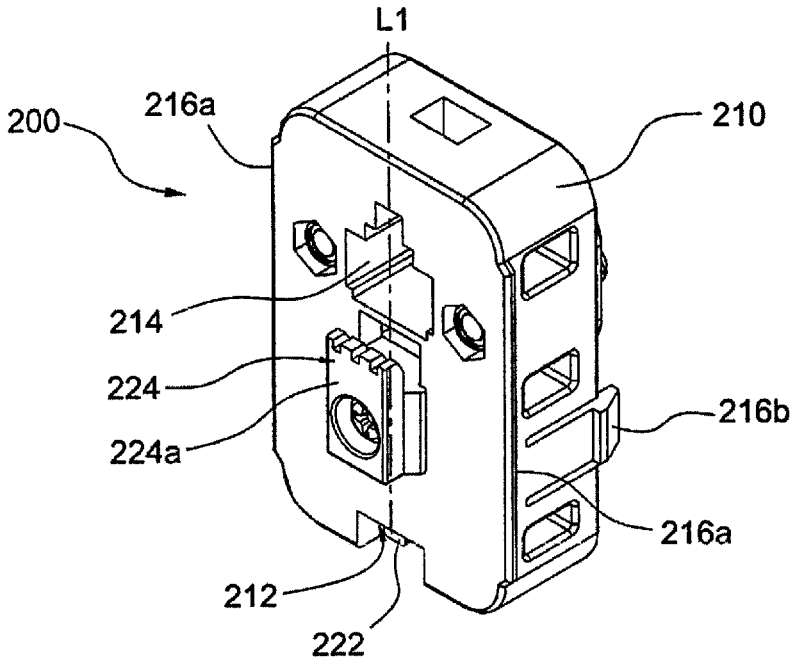
FIG. 3A is a further schematic view showing the cassette of the embodiment in the resting state wherein a crimping structure is shown.
Figure 3B:
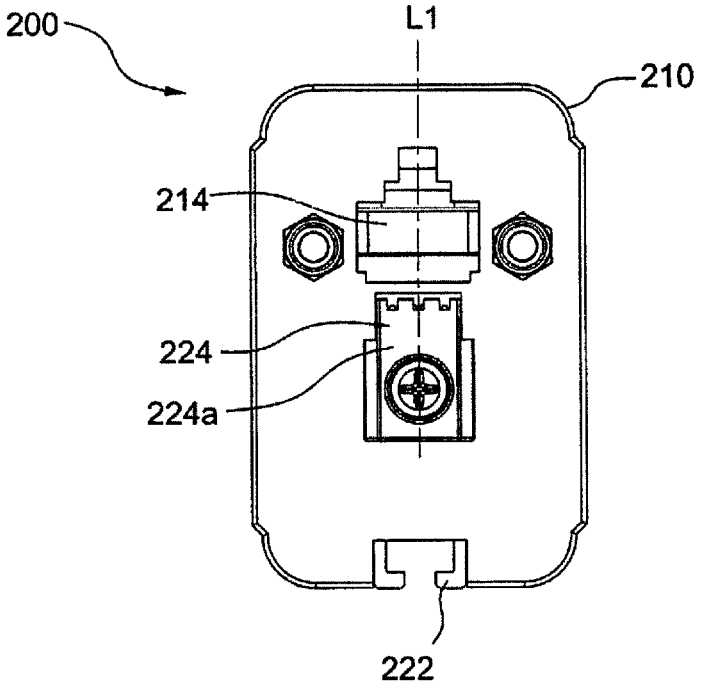
FIG. 3B is still a further schematic view showing the cassette of the embodiment in the resting state wherein the crimping structure is shown.
Figure 4A:
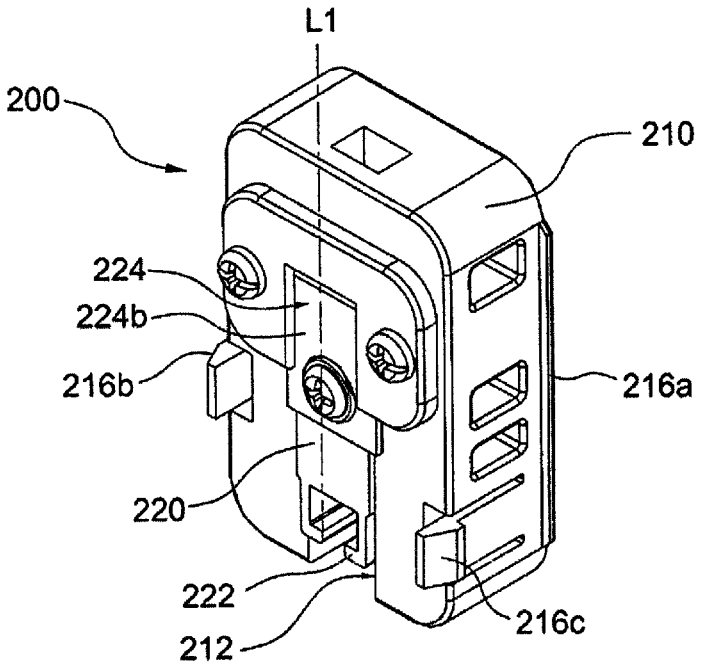
FIG. 4A is a schematic view showing the cassette of the embodiment in a working state wherein a shearing structure is shown.
Figure 4B:
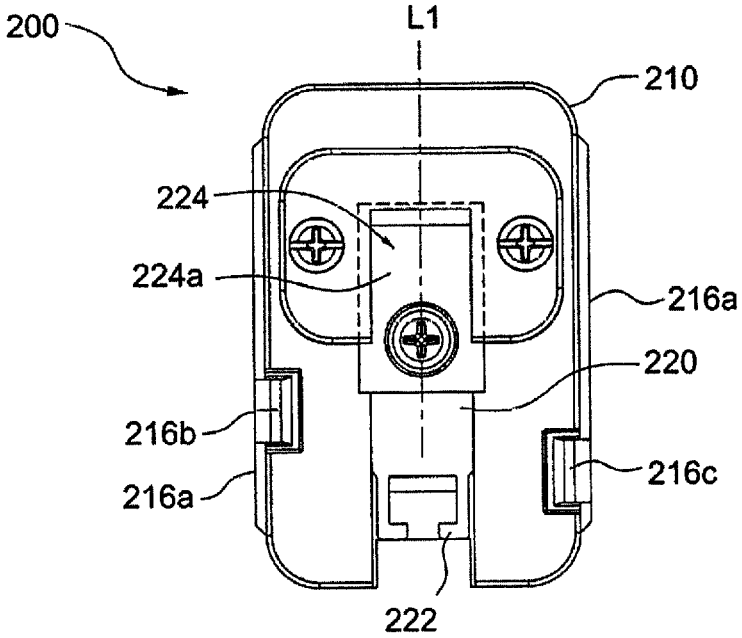
FIG. 4B is another schematic view showing the cassette of the embodiment in the working state wherein the shearing structure is shown.
Figure 5A:
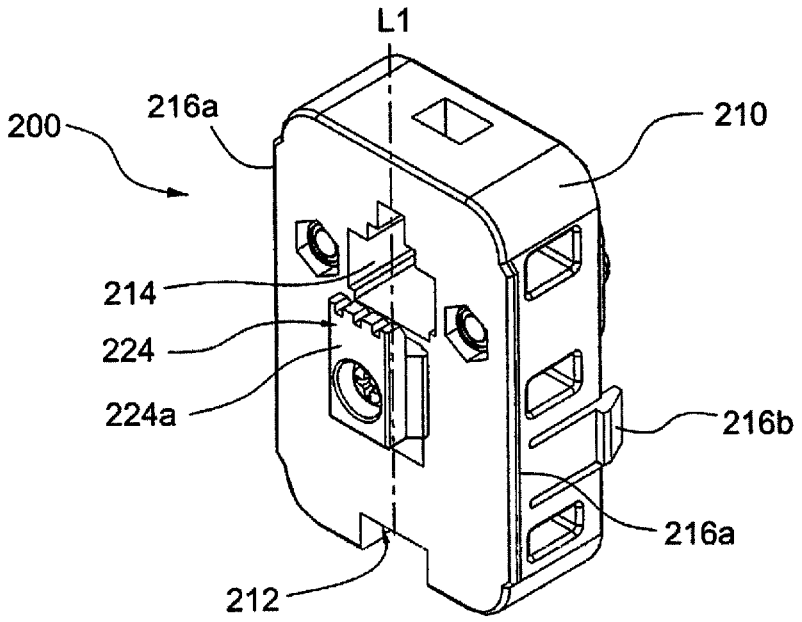
FIG. 5A is a further schematic view showing the cassette of the embodiment in the working state wherein a crimping structure is shown.
Figure 5B:
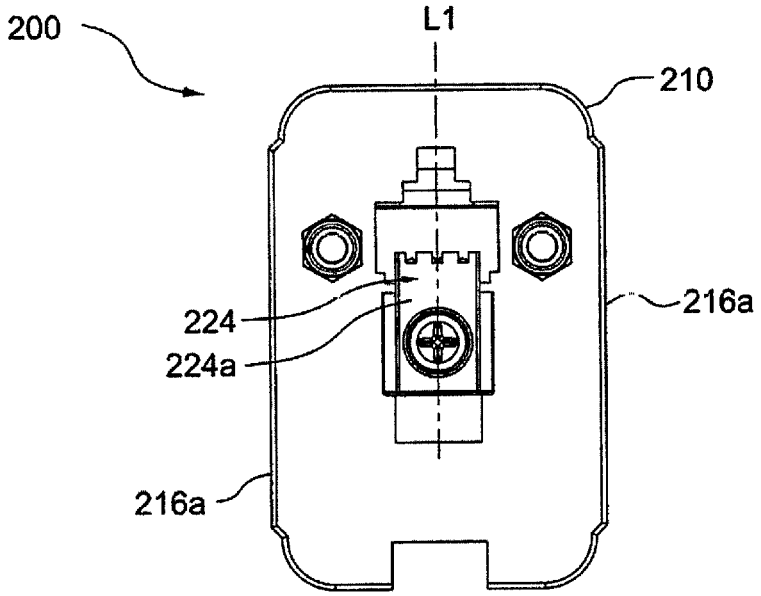
FIG. 5B is still a further schematic view showing the cassette of the embodiment in the working state wherein the crimping structure is shown.

In one embodiment, the at least one machining structure 224 comprises two machining structures, namely a crimping structure 224*a* disposed at one side of the cassette body 210 and a shearing structure 224*b* disposed at the other side of the cassette body 210. As shown in FIGS. 3A, 38, SA, and SB, the crimping structure 224*a* is a structure for crimping a crystal joint (connector). A shown in FIGS. 2A, 28, 4A and 48, the shearing structure 224*b* is a blade for cutting. As illustrated in FIGS. 4A, 48, 5A and 58, when the machining block 220 is driven to the working position, the crimping structure 224*a* partially overlaps with one side of the machining opening 214 and the shearing structure 224*b* fully overlaps with the other side of the machining opening 214.

Figure 6A:
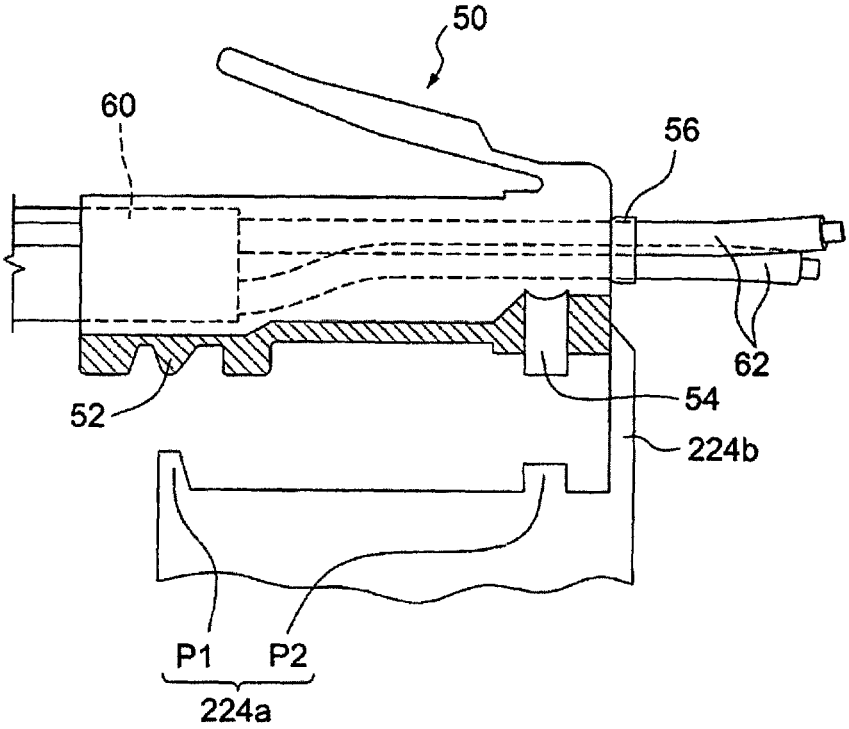
FIG. 6A is a schematic view showing a connector and a cable before being sheared and crimped.

In the embodiment shown in FIGS. 6A and 68, the crimping structure 224*a* for crimping a crystal connector 50 comprises two crimping blocks P1, P2, which perform the crimping function simultaneously. The first crimping block P1 is for crimping the body of the crystal connector 50 and the second crimping block P2 is provided between the first crimping block P1 and the shearing structure 224*b* for securing the electrical contact blades 54 contained therein to the core(s) 62 of the cable 60. When the machining block 220 is driven by the driving element 140 to the working position, the crimping structure 224*a* partially overlaps with one side of the machining opening 214 and the first crimping block P1 of the crimping structure 224*a* presses against a ridge 52 at the bottom of the crystal connector 50 so that the ridge 52 deforms and breaks. The deformed and broken ridge 52 thus squeezes the outmost insulator(s) of the cable so that the cable 60 is secured to an internal portion of the crystal connector 50. As such, a part of the crystal connector 50 holds the cable 60 and the crystal connector 50 is firmly secured to one end of the cable 60. At the same time, the second crimping structure P2 pushes the electrical contact blades 54 of the crystal connector 50 to move upward and punches through the insulator of the cores 62 of the cable 60 to electrically connect with the cores 62 of the cable 60, so that signals can be transmitted from the cores 62 through the crystal connector 50 to a corresponding female connector.

Figure 6B:
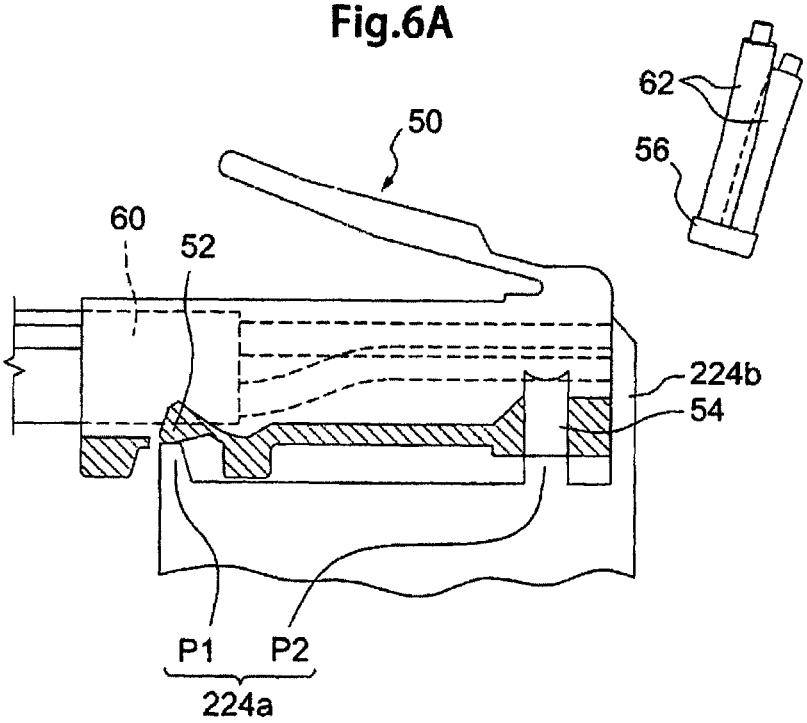
FIG. 6B is a schematic view showing the connector and the cable after being sheared and crimped.

In one embodiment, the shearing structure 224*b* is a blade for shearing off the redundant parts of the cores 62. When the machining block 220 is driven by the driving element 140 to the working position, the blade 224*b* is moved along the first axis (L1) until it fully overlaps with the side of the machining opening opposite to the crimping structure 224*a* and at the same time shears off the ends of the cores 62 that protrude from one end of the crystal connector 50. In a preferred embodiment, the blade 224 can also be arranged to shear off both the protruded parts of the cores 62 and the appendix 56 of crystal connector 50 as shown in FIGS. 6A and 68. As such, the ends of the sheared cores 62 are flush with the sheared end of the crystal connector 50. In alternative embodiments of the present invention, the location of the shearing structure 224*b* relative to the crystal connector 50 can be arranged in accordance with the needs of a specific user, and might be different from that shown in FIGS. 6A and 6B.

Figure 7A:
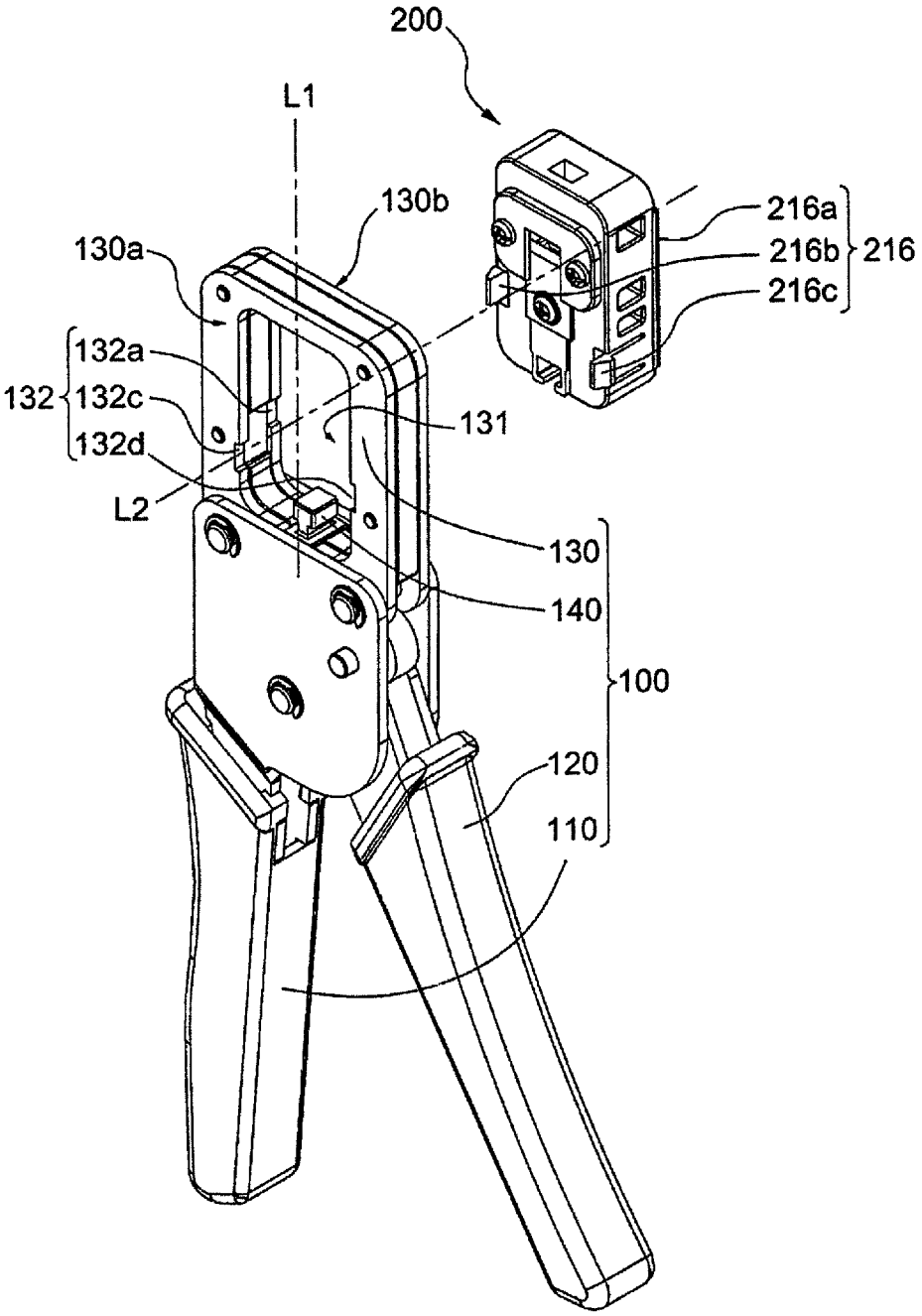
FIG. 7A is a schematic view showing one embodiment of the present invention in which a cassette is to be inserted into an opening of a head of a tool body from one side thereof.

To ensure that the machining block 220 works steadily and properly when it machines a connector and/or a cable, the cassette 200 should be firmly placed within the opening 131 of the head 130 of the tool body 100. As shown in FIGS. 7A and 78, the head 130 of the tool body 100 further comprises: a first connecting structure 132 disposed in the inner lateral surfaces of the opening 131 and the cassette body 210 of the cassette 200 further comprises: a second connecting structure 216 disposed thereon, wherein the first connecting structure 132 engages with the second connecting structure 216 so that the cassette body is secured within the tool body 100. The design of the engagements between the first connecting structure 132 and second connecting structure 216 as described below has the benefit of easy assembly of the cassette 200 to the head 130 of the tool body 100 and easy disassembly of the cassette 200 from the head 130 of the tool body 100, in addition to the benefit of the firm engagement between the cassette 220 and the opening 131 of the head 130 of the tool body 100.

The second connecting structure 216 comprises a stopper 216*a* abutting against one of a first surface 130*a* and a second surface 130*b* of the head 130 of the tool body 210 along a second axis (L2) perpendicular to the first axis (L1) when the cassette body 210 is disposed in the opening 131 of the head 130 of the tool body 100. The second connecting structure 216 comprises: a first hook 216*b* and a second hook 216*e* respectively disposed at the two lateral sides of the cassette body 210. The first hook 216*b* and the second hook 216*c* extend away from the stopper 216 a in a direction substantially parallel to the second axis (L2). When the stopper 216*a* abuts against one of the first surface 130*a* and the second surface 130*b* of the head 130 of the tool body 210, the first hook 216*b* and the second hook 216*c* engage with the other one of the first and the second surfaces 130*a*, 130*b* of the head 130 of the tool body 100 so as to secure the cassette 200 in the head 130 of the tool body 100.

Figure 7B:
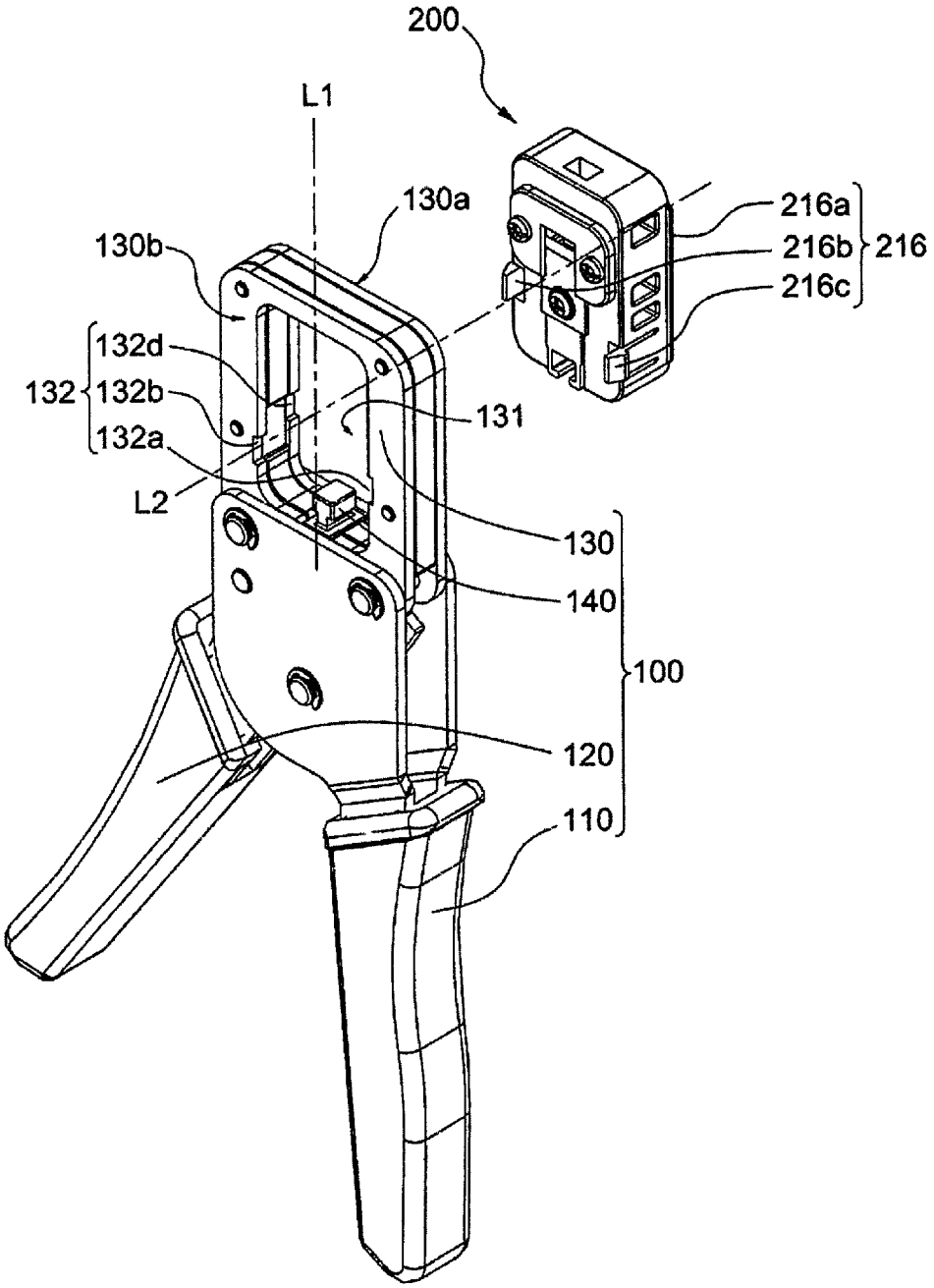
FIG. 7B is a schematic view showing one embodiment of the present invention in which a cassette is to be inserted into an opening of a head of a tool body from the other side thereof.

Referring to FIGS. 7A and 7B, one embodiment of the present invention provides a crimp tool 10 that is convenient for both right-handed and left-handed users. Specifically, the cassette 200 can be inserted into the opening 131 of the head 130 of the body tool 100 from either the first surface 130*a* or the second surface 130*b* of the head 130 of the tool body 100. As the second handle 120 is pivotable in relation to the first handle 110 with respect to a pivot provided at the joints of the first handle 110 and the second handle 120, the first handle 110 is defined as a stationary handle and the second handle 120 is defined as the moving handle. When a right-handed user uses the crimp tool 10, the cassette 200 might be inserted into the opening 131 of the head 130 of the tool body 100 from the second surface 130*b* of the head 130 as shown in FIG. 7A. As such, the right-handed user can use his/her left hand to hold a connector with cable and place it into the machining opening 214 of the cassette 200 and uses his/her right hand to operate the crimp tool 10. The first handle 110 is placed between and abuts against the thumb and the palm of the right hand so that the first handle 110 is held still. The other four fingers of the right hand are placed upon the second handle 120 for pressing against the second handle 120 to move toward the first handle 110. When the right handle 120 is moved adjacent to (or abutting against) the first handle 110, the machining block 220 is driven by the driving element 140 to the working position and the connector with cable is machined.

Similarly, when a left-handed user operates the crimp tool 10, the cassette 200 might be inserted into the opening 131 of the head 130 of the tool body 100 from the first surface 130*a* of the head 130 as shown in FIG. 7B. Accordingly, the left-handed user can use his/her right hand to hold a connector with cable and place it into the machining opening 214 of the cassette 200 and uses his/her left hand to operate the crimp tool 10. The first handle 110 is placed between and abuts against the thumb and the palm of the left hand so that the first handle 110 is held still. The other four fingers of the left hand are placed upon the second handle 120 for pressing against the second handle 120 to move it toward the first handle 110 so as to machine the connector.

In one embodiment of the present invention, the first hook 216*b* and the second hook 216*c* are asymmetrically disposed at the two lateral sides of the cassette body 210 along the direction of the first axis (L1). The first connecting structure 132 comprises: a first notch 132*a*, a second notch 132*b*, a third notch 132*c* and a fourth notch 132*d* wherein the first notch 132*a* and the third notch 132*c* are disposed in one lateral inner surface of the opening 131 of the head 130 and the second notch 132*b* and the fourth notch 132*d* are disposed in the other lateral inner surface of the opening 131 of the head 130. The first notch 132*a* and the fourth notch 132*d* are at the same first height and the second notch 132*b* and the third notch 132*c* are at the same second height. The first height is higher than the second height. The first notch 132*a* and the second notch 132*b* form a depression from the second surface 130*b* of the head 130 and the third notch 132*c* and the fourth notch 132*d* form a depression from the first surface 130*a* of the head 130.

With the above structures, when the cassette 200 is inserted into the opening 131 of the head 130 of the tool body 100 from the second surface 130*b* of the head 130 as shown in FIG. 7A along the second axis (L2), the first hook 216*b* and the second hook 216*c* respectively engage with the first notch 132*a* and the second notch 132*b*. The heads of the first hook 216*b* and the second hook 216*c* will ultimately abut against the first surface 130*a* of the head 130 and the stopper 216*a* abuts against the second surface 130*b* of the head 130. Similarly, when the cassette 200 is inserted into the opening 131 of the head 130 of the tool body 100 from the first surface 130*a* of the head 130 as shown in FIG. 78 along the second axis (L2), the first hook 216*b* and the second hook 216*c* respectively engage with the fourth notch 132*d* and the third notch 132*c*. The heads of the first hook 216*b* and the second hook 216*c* will ultimately abut against the second surface 130*b* of the head 130 and the stopper 216*a* abuts against the first surface 130*a* of the head 130. Thus, the cassette 200 can be placed into the opening 131 of the head from either the first surface 130*a* or the second surface 130*b* of the head 130 depending on the habits of the users. Under either of the two assembly manners, the hand tool 100 performs the same crimping and/or shearing functions well.

In addition to the benefits mentioned above, with both the crimping structure 224*a* and the shearing structure 224*b* provided at the machining block 220, the crimping tool 100 is capable of being used in one step to simultaneously secure the crystal connector 50 to the cable 60, electrically connect the electrical contact blades 54 of the crystal connector 50 to the cores 62 of the cable 60, and shear off the both the protruded parts of the cores 62 and the appendix 56 of crystal connector 50.

The foregoing embodiments are illustrative of the technical concepts and characteristics of the present invention so as to enable a person skilled in the art to gain insight into the contents disclosed herein and to implement the present invention accordingly. However, it is understood that the embodiments are not intended to restrict the scope of the present invention. Hence, all equivalent modifications and variations made to the disclosed embodiments without departing from the spirit and principle of the present invention should fall within the scope of the appended claims.

What is claimed is:

1. A cassette for being removably inserted in a crimp tool, the cassette comprising:

a) a cassette body having a machining opening therein for receiving a connector;

b) a machining block slidably disposed in the cassette body, the machining block having an engagement element for being detachably engaged with a driving element of a body of the crimp tool such that the machining block slides along a first axis to move toward or away from the machining opening to machine, the machining block comprising a shearing structure and a crimping structure; and c) the cassette body comprising a stopper and first and second hooks extending from lateral sides of the cassette body for releasably holding the cassette body within the crimp tool.

2. The cassette of claim 1, wherein the first and second hooks are disposed on a side of cassette body opposite the stopper.

3. The cassette of claim 1, wherein the first hook and the second hook are asymmetrically disposed at the lateral sides of the cassette body along the direction of the first axis.

4. The cassette of claim 1, wherein the engagement element is a female structure.

5. The cassette of claim 1, wherein the cassette body is provided with a slot therein, and the machining block is slidably disposed in the slot.

6. The cassette of claim 1, wherein the machining block comprises: the crimping structure disposed at one side of the cassette body and the shearing structure disposed at an opposite side of the cassette body and wherein when the machining block is driven to a working position, the crimping structure partially overlaps with one side of the machining opening and the shearing structure fully overlaps with the opposite side of the machining opening.

7. The cassette of claim 1, wherein the crimping structure comprises a first crimping block for crimping a body of the connector within the machining opening.

8. The cassette of claim 7, wherein the crimping structure further comprises a second crimping block for pushing electrical contact blades of the connector through insulators and into contact with conductors within the connector.

9. The cassette of claim 1, wherein the crimping structure comprises a crimping block for pushing electrical contact blades of the connector through insulators and into contact with conductors within the connector.

10. The cassette of claim 1, wherein the stopper and the first and second hooks releasably hold the cassette body within the crimp tool such that the cassette is at least one of insertable into or removable from either one of opposite sides of the tool body.

11. A cassette for being removably inserted into an opening in a head of a crimp tool, the cassette comprising:

a) a cassette body having a machining opening therein for receiving a connector;

b) a machining block slidably disposed in the cassette body, the machining block having an engagement element for being detachably engaged with a driving element of a body of the crimp tool such that the machining block slides along a first axis to move toward or away from the machining opening to machine, the machining block comprising a shearing structure and a crimping structure; and c) the cassette body further comprising connecting structures comprising:

(i) a stopper disposed at a first face of the cassette and extending beyond a lateral side of the cassette body; and (ii) a releasable connecting structure extending beyond a second face of the cassette, the second face being on an opposite side of the cassette than the first face.

12. The cassette of claim 11, wherein the releasable connecting structure extends from a lateral side of the cassette body.

13. The cassette of claim 11, wherein the releasable connecting structure comprises at least one hook extending away from the stopper on a lateral side of the cassette body.

14. The cassette of claim 11, wherein the stopper and the releasable connecting structure of the cassette body are configured so as to be capable of releasably engaging the head of the crimp tool to allow easy assembly of the cassette into the head of the crimp tool by hand and easy disassembly of the cassette from the head of the crimp tool, while providing firm engagement between the cassette body and the head of the crimp tool.

15. The cassette of claim 11, wherein the machining block comprises: the crimping structure disposed at one side of the cassette body and the shearing structure disposed at an opposite side of the cassette body and wherein when the machining block is driven to a working position, the crimping structure partially overlaps with one side of the machining opening and the shearing structure fully overlaps with the opposite side of the machining opening.

16. The cassette of claim 11, wherein the crimping structure comprises a first crimping block for crimping the body of the connector within the machining opening and a second crimping block for pushing electrical contact blades of the connector through insulators and into contact with conductors therein.

17. A cassette for machining a connector, the cassette being capable of being detachably disposed in a tool body, wherein the tool body comprises a head portion with a receiving opening and a driving element, the cassette comprising:

a) a cassette body for being detachably disposed in the receiving opening of the head portion of the tool body;

b) a machining block, slidably disposed in the cassette body, the machining block having a connecting portion for being detachably engaged with the driving element of the tool body; and c) wherein the cassette body comprises a connecting structure that is non-removable from the cassette body, the connecting structure being configured to detachably engage the tool body when the cassette is seated within the receiving opening of the tool body, wherein the connecting structure comprises hooks.

* * * * *